United States Patent [19]

Kurosawa et al.

[11] 4,222,195

[45] Sep. 16, 1980

[54] COMBINATION OF RUNNING TOY AND TRACK ALONG WHICH TOY RUNS

[75] Inventors: Kenzo Kurosawa; Fukuji Hachimura, both of Tokyo, Japan

[73] Assignee: Gakken Co., Ltd., Tokyo, Japan

[21] Appl. No.: 22,864

[22] Filed: Mar. 21, 1979

[30] Foreign Application Priority Data

| | | | |
|---|---|---|---|
| Aug. 25, 1978 | [JP] | Japan | 53/116380[U] |
| Aug. 28, 1978 | [JP] | Japan | 53/117667[U] |
| Oct. 11, 1978 | [JP] | Japan | 53/139389[U] |
| Nov. 20, 1978 | [JP] | Japan | 53/159873[U] |

[51] Int. Cl.[3] ..... A63H 11/10

[52] U.S. Cl. ..... 46/202; 46/212; 46/204; 46/218; 246/415 A

[58] Field of Search ..... 46/202, 206, 212, 204, 46/218, 265, 266, 262, 257, 260, 263, 261, 40; 238/10 R, 10 A, 10 B, 10 C, 10 E, 10 F; 74/342, 343, 359, 373, 344; 246/415 A; 104/149; 105/1 T

[56] References Cited

U.S. PATENT DOCUMENTS

| | | | |
|---|---|---|---|
| 3,025,711 | 3/1962 | Sommer | 74/342 |
| 3,154,022 | 10/1964 | Lohr et al. | 246/415 A |
| 3,466,791 | 9/1969 | Enfalt | 46/260 |
| 3,481,279 | 12/1969 | Cooper | 246/415 A |
| 3,514,895 | 6/1970 | Ryan et al. | 46/260 |
| 3,540,153 | 11/1970 | Aoki | 46/261 |
| 3,562,950 | 2/1971 | Genih | 46/204 |
| 3,589,063 | 6/1971 | Genih | 46/202 |
| 3,589,064 | 6/1971 | Harada | 46/261 |
| 4,100,696 | 7/1978 | Ogasawara | 46/261 |
| 4,128,964 | 12/1978 | Ogasawara | 46/40 |

*Primary Examiner*—Louis G. Mancene
*Assistant Examiner*—Michael J. Foycik, Jr.
*Attorney, Agent, or Firm*—Irving M. Weiner; John L. Shortley; Melvin Yedlin

[57] ABSTRACT

A toy including a powered running toy member and a track along which the toy member runs, the toy member being made to run by rotation of the driving wheels of the toy member. The running toy member is provided with a switching arm which is attached to the lower side thereof and is adapted to trigger an operation for changing the running direction, and a mechanism for effecting the change of running direction when actuated by the swinging arm. On at least one end of the track, a mechanism is provided for causing swinging movement of the switching arm to automatically change the running direction of the toy member as the toy member reaches that end of the track. The running toy member has the form of an animal such as, for example, a bird, and incorporates various mechanisms for effecting various actions simulating those of the actual animal, e.g., turning of the head, opening of a beak, etc., by making use of power provided by the driving wheels. The track is formed by a plurality of track pieces, at least one of which may be provided with the mechanism for causing swinging of the switching arm so that turning of the running toy member can be effected at a desired position on the track.

9 Claims, 13 Drawing Figures

COMBINATION OF RUNNING TOY AND TRACK ALONG WHICH TOY RUNS

BACKGROUND OF THE INVENTION

The present invention relates to a toy including a running toy member adapted to run along a track by rotation of the driving wheels of the toy member. More particularly, the invention is concerned with a toy member which is adapted to move back and forth along a track in response to reversal of the direction of rotation of the driving wheels. The toy member turns its head upon reversal of the driving wheels, and performs various actions when its head turns.

Toys are known which run along a track formed of a plurality of track pieces. If the track is in the form of an endless or closed loop, the toy need not be provided with a mechanism for reversing the running direction, because the toy runs continuously in only one direction. However, when the track includes a starting end and a terminal end, the toy must be provided with a mechanism for switching the running direction thereof in order that the toy may run continuously in a reciprocating manner along the track. In the case of a toy adapted to run on a track by rotation of the driving wheels, the toy is adapted to run back and forth by alternate reversal of the rotation of the driving wheels. Such switching of the running direction of the toy itself can attract an infant's interest. However, this interest will be very much enhanced if other actions, such as singing or turning of the head portion toward the new running direction, are performed at the time the running direction is switched. In particular, when the toy has the appearance of an animal, it is important and highly desirable that the toy perform various actions simulating those of a real living animal. The commercial value of a running toy having the configuration of an animal will be increased by a combination of such various actions.

The present invention provides a running toy capable of performing a plurality of the above-described desired actions.

SUMMARY OF THE INVENTION

The present invention provides a toy comprising a track and a running toy member having rotatable driving wheels, the running toy member being adapted to run along the track by rotation of the driving wheels. The running toy member includes a body, and a switching arm attached to the lower surface of the body. A lever is operatively connected to the switching arm, and is disposed in the body of the running toy member. A first shaft having a first worm gear disposed thereon is mounted proximal to the lever. Also provided is a driving gear connected to a driving power source. A gear is attached to the first shaft and directly meshes with the driving gear. A driven gear is connected to the driving wheels, and an intermediate gear is provided by which the gear attached to the first shaft meshes with the driven gear. When the lever and the gear attached to the first shaft are brought into relative meshing engagement by swinging movement of the switching arm to move the first shaft in the axial direction, the gear attached to the first shaft is brought into direct meshing engagement with the driven gear connected to the driving wheels, to thus reverse the rotational direction of the driving wheels.

It is an object of the invention to provide a toy including a running toy member adapted to run along a track by rotating the driving wheels of the running toy member. A switching arm is swingably mounted on the running toy member and an internal mechanism for switching the running direction is adapted to switch the direction of rotation of the driving wheels, so that the running toy member may run back and forth along a track having starting and terminal ends.

It is another object of the invention to provide a toy wherein a gear is mounted at each end of the track and is adapted to be rotated by the driving wheels of the running toy member. A worm gear integral with such gear is adapted to be engaged by the switching arm such that the switching arm is swung by the worm gear which in turn is driven by the gear. In this manner, the switching mechanism in the running toy member is actuated after the elapse of a predetermined time, so that the switching of the running direction is delayed.

Yet another object of the invention is to provide a running toy member which includes a body and a head rotatable with respect to the body. The head has a rack for engagement with a pinion which in turn engages with the driving wheels. The head is turned through the action of the pinion as the driving wheels are reversed, so that the running toy member directs its head in the running direction even when the running direction is changed by reversal of the driving wheels.

It is a further object of the invention to provide a toy wherein a projection is mounted on the track. The projection is adapted to be moved as desired by means of a manually operable lever into and out of the path of the running toy member for optional engagement with the switching arm to swing the latter. Thus, the running direction of the running toy member can be changed at any position on the track, as well as at both ends of the track.

These and other objects and advantages of the invention will become apparent from the following description of a preferred embodiment, taken in conjunction with the accompanying drawings.

DETAILED DESCRIPTION OF PREFERRED EMBODIMENTS

Figure 1:
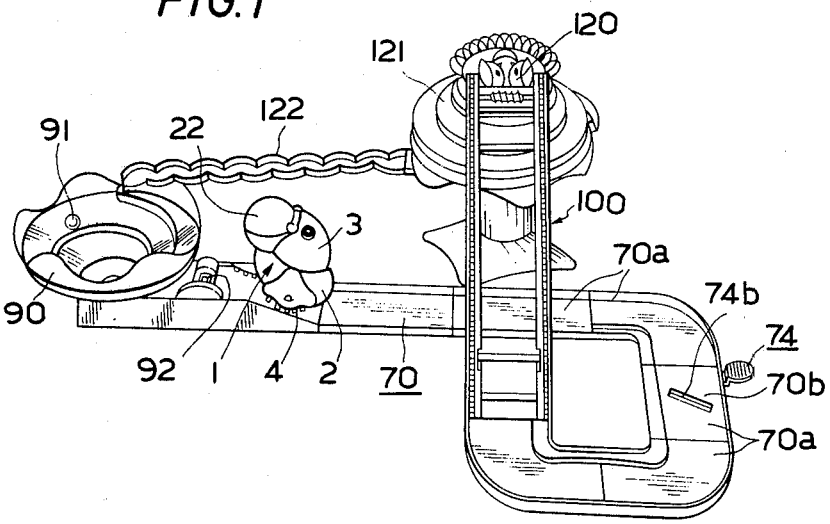
FIG. 1 is a perspective view of an entire toy according to the present invention.

With reference to FIG. 1, the general construction of the toy, including running toy member 1, in accordance with the invention, is depicted. The running toy member 1 has the shape of a bird, and is adapted to make an action simulating a parent bird feeding a young bird, in the following manner.

The running toy member 1 is adapted to run along a track 70 formed by a plurality of track pieces 70*a* connected in series. The parent bird arriving at one end of the track then opens its beak 22 to receive a piece of ball-shaped feed 91 sprung up by resilient means from a bowl 90. Then, the parent bird reverses its direction and runs along the track 70 in the opposite direction. The parent bird then climbs an inclined track piece 100 and gives the feed 91 to yound birds 120 waiting at the top of the slope. Subsequently, the parent bird makes another turn, descends the inclined track piece 100, and runs along the track 70 to the end where the bowl 90 is placed. After again receiving the feed 91 from the bowl 90, the parent bird repeats the same action. The feed 91 given to the young birds 120 is made to roll along a spiral slope 121, and is returned to the bowl 90 via a chute 122.

Figure 2:
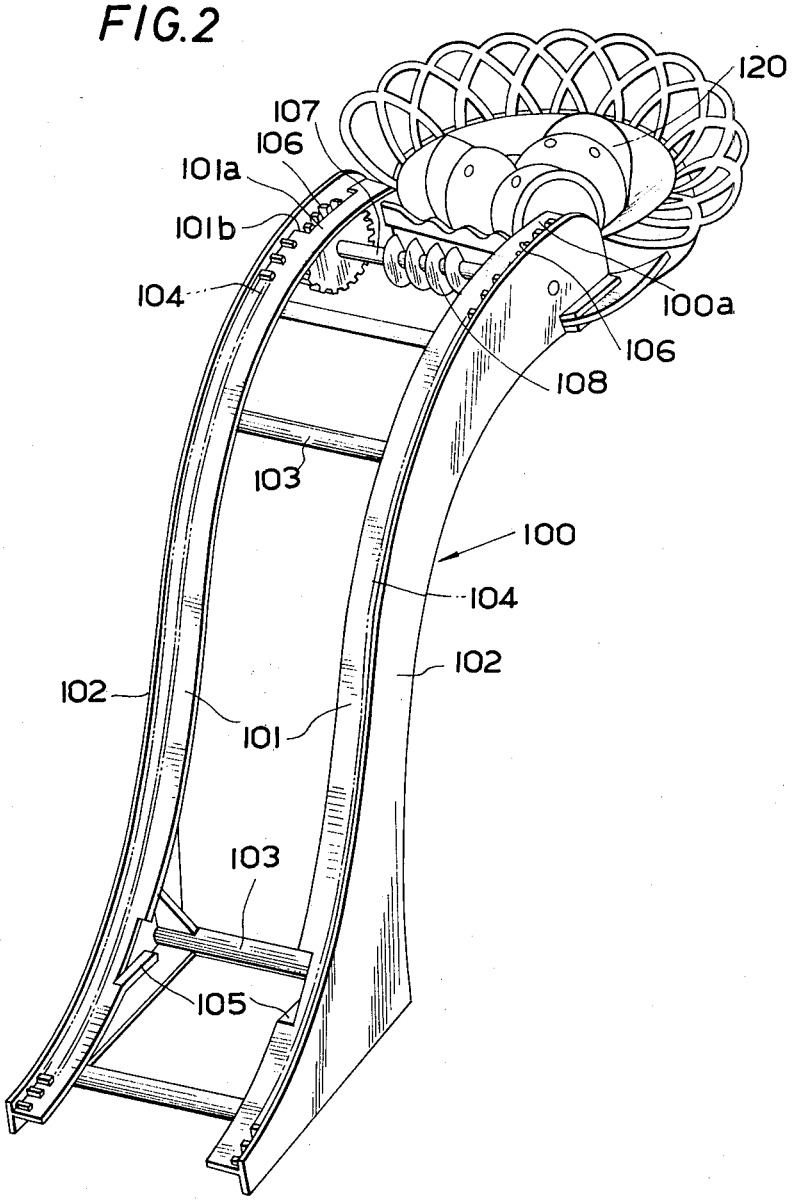
FIG. 2 is a perspective view of an inclined track piece forming a part of the track.

Referring now to FIG. 2, the inclined track piece 100 forming a part of track 70 includes left and right rails 101, 101; wall plates 102, 102 forming the outer surfaces of rails 101, 101; and a plurality of connecting pieces 103, 103 interconnecting both wall plates 102, 102. The rails 101, 101 are made separate and extend in parallel relation to each other in a steep slope. The upper surfaces of rails 101, 101 are provided with longitudinal racks 104. Notches 105, 105 are relatively symmetrically formed at the lower portions of rails 101, 101 where the racks 104 are not provided.

The top 100*a* of inclined track piece 100 is generally horizontal. Thus, the tops 101*a* of rails 101 are formed to extend substantially horizontally. The rack 104 terminates at top 101*a*. A gear 106 is exposed in alignment with each rack 104 through a window 101*b*. The gears 106 are mounted at opposite end portions of a shaft 107 rotatably supported at corresponding portions of wall plates 102, 102. A worm gear 108 is provided between both gears 106, 106.

Figure 3:
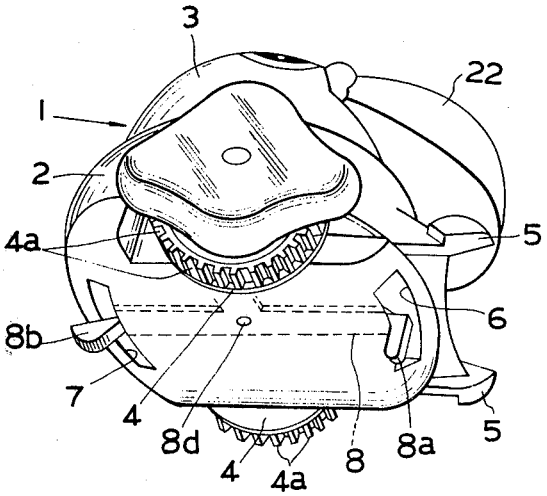
FIG. 3 is a bottom perspective view of a running toy member.

FIG. 3 is a perspective view of the running toy member 1 as viewed from the lower side thereof at a deviated angle. The running toy member 1 has a body 2 having the shape of a bird, a rotatable head 3, and toothed driving wheels 4 having peripheral gear teeth 4*a* provided at both sides of the lower portion of body 2. Engaging tabs 5, 5 are extended forwardly from the front end at both sides of body 2. A switching arm 8 swingable around a pivot pin 8*d* extends between front and rear openings 6, 7 formed in the lower surface of body 2. Engaging portions 8*a*, 8*b* formed at both ends of switching arm 8 are projected downwardly through openings 6, 7.

Figure 4:
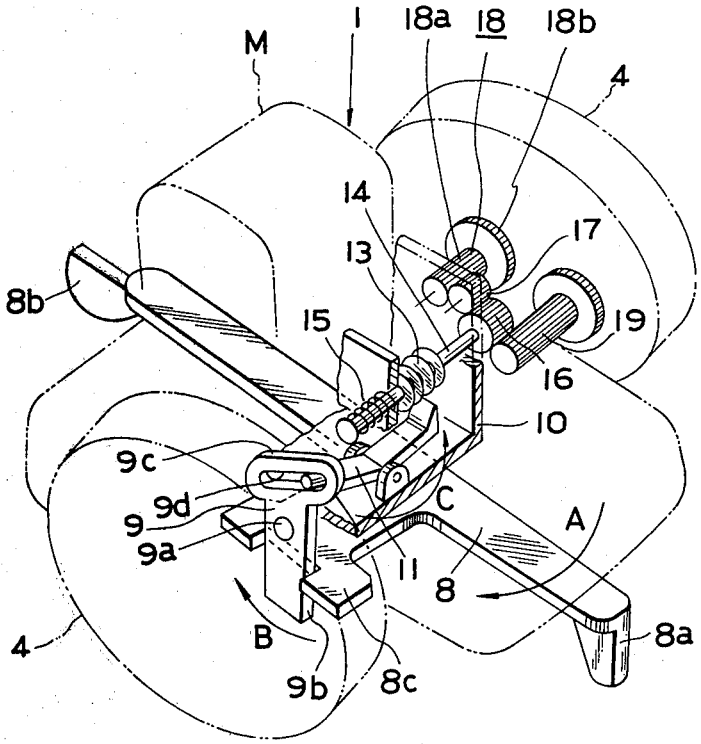
FIG. 4 is a perspective view of an essential portion of a switching mechanism incorporated in the body of the running toy member.

As shown in FIG. 4, a forked hook 8*c* is projected laterally from the center of switching arm 8. A swinging member 9 pivoted by a shaft 9*a* loosely engages at its lower end 9*b* with hook 8*c*. An enlarged portion 9*c* is integrally formed at the upper end of swinging member 9. A linear engaging slot 9*d* is formed in enlarged portion 9*c* so as to extend at a particular inclination, with one end of slot 9*d* being higher than the other.

Figure 5:
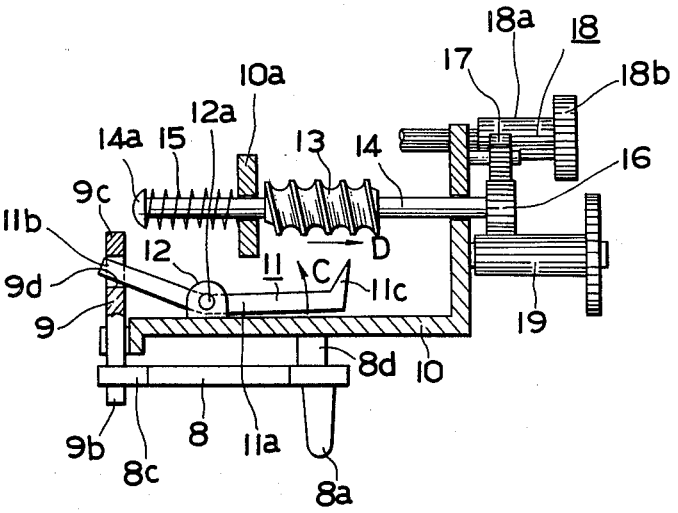
FIG. 5 is a front elevational view of the switching mechanism in a pre-operation state.
Figure 6:
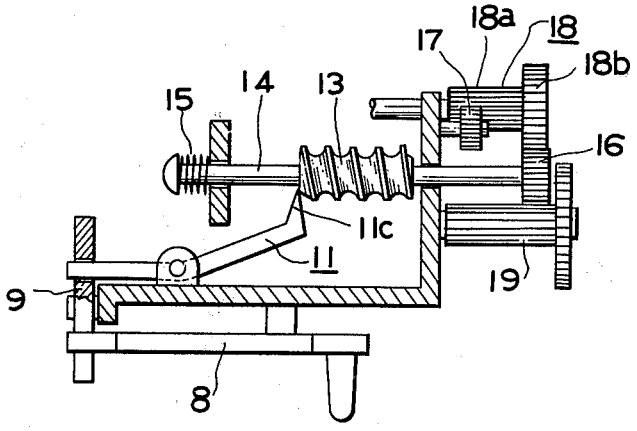
FIG. 6 is a front elevational view of the switching mechanism after operation.

As shown in FIGS. 4 through 6, a switching lever 11 is pivotally mounted for free vertical swinging movement on a frame 10 of the running toy member 1 by means of a shaft 12*a* of a bracket 12. Lever 11 is bent at its pivoted portion through which the pivot shaft 12*a* passes, and an upwardly bent portion 11*b* extending obliquely upwardly from the base portion 11*a* is inserted at its outer end in engaging slot 9*d* of swinging member 9. An engaging piece 11*c* bent at an acute angle is integrally formed at the opposite end of base portion 11*a*.

A worm gear 13 is disposed above switching lever ll. Worm gear 13 is integral with a shaft 14 which is axially slidably carried by frame 10, and is therefore movable in the axial direction. A spring 15 is fitted onto one end of shaft 14 where a stopper 14*a* is provided, so as to be compressed between the stopper 14*a* and the frame portion 10*a* by which the shaft 14 is supported. Fixed to the other end of shaft 14 extending outwardly from frame 10 is a gear 16 meshing with a smaller diameter gear 18*a* of a double driven gear 18, through an intermediate gear 17 mounted on frame 10. The gear 18 is operatively connected to the driving wheels 4 of the running toy member 1, and is adapted to drive the latter. A driving gear 19 is connected to a drive shaft which in turn is coupled to a motor M as shown in FIG. 4. Gear 19 meshes with gear 16 of shaft 14. Therefore, in the state shown in FIGS. 4 and 5, the power of motor M is transmitted to driving wheels 4 through driving gear 19, gear 16, intermediate gear 17, and the smaller diameter gear 18*a* of driven gear 18.

The driven gear 18 has a larger diameter gear 18*b* integrally formed with the smaller diameter gear 18*a*. Gears 18*a*, 18*b* are arrayed in the direction of axial movement of shaft 14.

Figure 7:
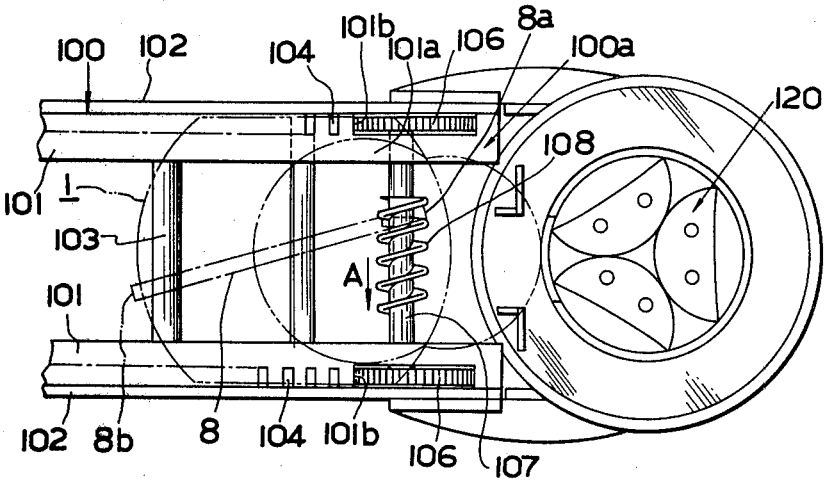
FIG. 7 is a plan view of the end portion of an inclined track piece, showing a mechanism for changing the running direction by engagement of a switching arm with a worm gear mounted on the inclined track piece.

In operation, the running toy member 1 runs along the track 70 and reaches the inclined track piece 100. The engaging tab 5 then mates with the notch 105, so that the engaging tab 5 engages the bottom side of rails 101 while the toy member 1 is inclined, and the teeth 4*a* of driving wheels 4 come into engagement with the corresponding rack 104, whereby the toy member 1 starts to ascend along the slope. At the top of inclined track piece 100, the driving wheels 4 are transferred from the racks 104 to the gears 106 disposed forwardly of racks 104, so that the teeth 4*a* of driving wheels 4 mesh with the teeth of gears 106. As a result, the gears 106 are driven by the driving wheels 4, and the toy member 1 is kept stationary at the top 100*a*. When the toy member 1 thus reaches the top 100*a*, the switching arm 8 comes into engagement at its end 8*a* with one end of the worm gear 108, as shown in FIG. 7. Then, as the gears 106 are rotated, the rotation of the worm gear 108 acts to swing the switching arm 8 in the direction of arrow A in FIGS. 4 and 7. As a result of this swinging movement in the direction of arrow A, the swinging member 9 is rotated around the pivot shaft 9*a* in the direction of arrow B, as shown in FIG. 4. Consequently, the bent portion 11*b* of switching lever 11, which has been in engagement with the highest portion of the engaging slot 9d of swinging member 9, is moved to the lowest portion of engaging slot 9d, so that switching lever 11 is rotated in the direction of arrow C as indicated in FIG. 5. As a result, the engaging piece 11c at the end of switching lever 11 is raised to come into engagement with worm gear 13. Because shaft 14 is being rotated by driving gear 19, the worm gear 13 produces a force which acts on the switching lever 11 to shift the worm gear 13 in the direction of arrow D (FIG. 5). As a result, the shaft 14 slides to compress spring 15, and gear 16 attached to the end of shaft 14 leaves intermediate gear 17 to directly mesh with the larger diameter gear 18b of driven gear 18. Consequently, the driving wheels 4 are reversed, and the running direction of toy member 1 is changed. This state is shown in FIG. 6.

In the described operation, the period starting from the commencement of engagement of worm gear 108 with the engaging portion 8a and ending with the completion of swinging of switching arm B by worm gear 108 to the end of the swinging stroke, and the period of engagement of lever 11 and worm gear 13 with each other, combine to define a delay time. The parent bird or running toy member 1 gives the feed 91 to the young birds 120 during this delay time. After giving the feed 91, the running toy member 1 starts to run in the opposite direction as a result of the reversal of the driving wheels 4.

A worm gear 92 similar to that provided at the top 100a is also disposed at the position of bowl 90, so as to be engaged by the other engaging portion 8b of switching arm 8. As a result of such engagement, the engaging piece 11c of lever 11 is lowered from the position shown in FIG. 6, so that shaft 14 is returned to the starting position shown in FIG. 5 by the resilient force exerted by spring 15. As a result, gear 16 meshes indirectly with driven gear 18 via gear 17, so that driving wheels 4 are again reversed.

An explanation will be given hereinafter as to the mechanism for turning head 3, which turning is effected at the time the running direction is changed.

Figure 8:
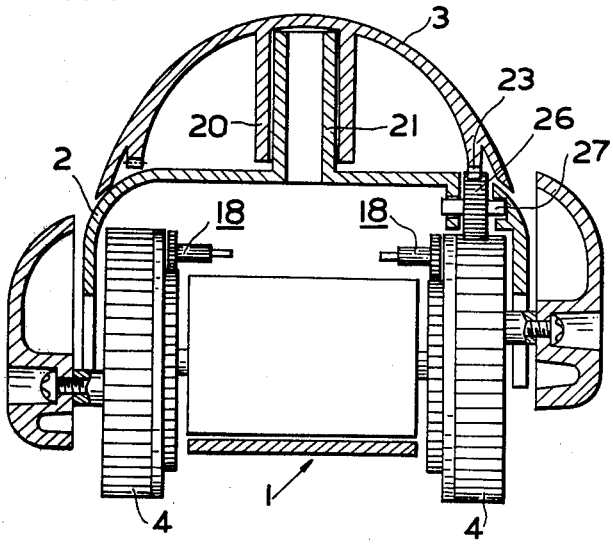
FIG. 8 is a longitudinal sectional view of the running toy member, showing how the body and head of the running toy member are assembled.
Figure 9:
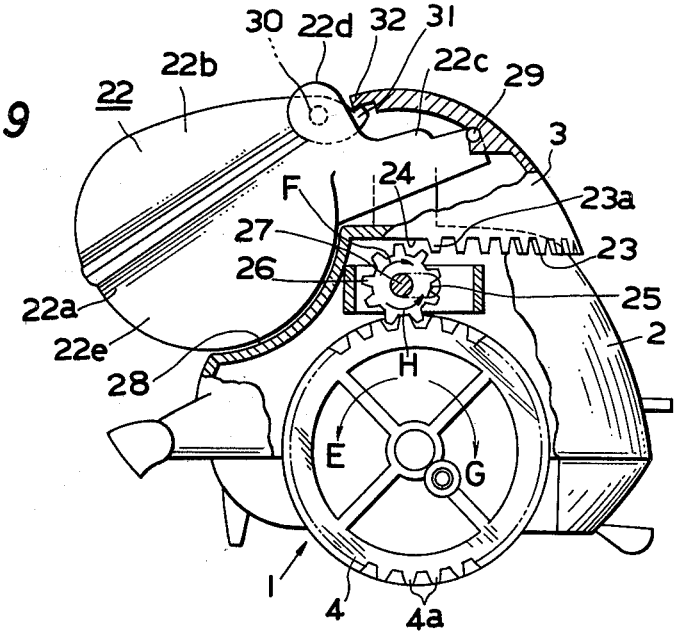
FIG. 9 is a sectional view of an essential portion of the running toy member in the state before turning of the head.
Figure 10:
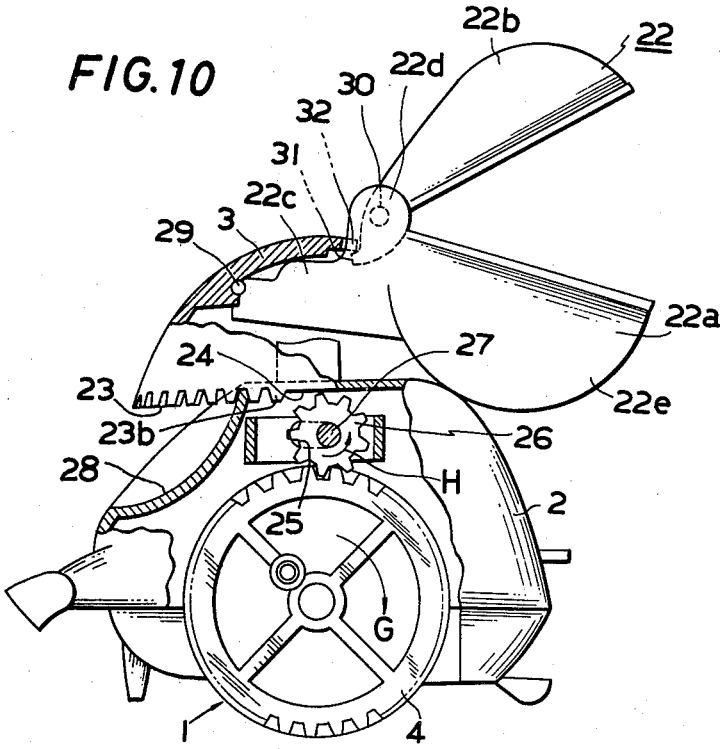
FIG. 10 is a sectional view similar to that of FIG. 9 showing the state after turning of the head.

As shown in FIG. 8, the head 3 has a cap-like shape, and is provided with an internal hollow support shaft 20 which rotatably fits around a stem 21 extending upwardly from body 2. At the opposite side of head 3 to the beak 22 a rack 23 is formed over the lower semi-circular edge of head 3, as shown in FIGS. 9 and 10. The lower edge of head 3 is recessed upwardly at both ends 23a, 23b of rack 23 to form recesses 24, 24.

At one side of body 2 an elongated slot 25 of a predetermined length is formed to extend in the same direction as rack 23. A shaft 27 of a pinion 26 is loosely received by elongated slot 25. Shaft 27 of pinion 26 is movable along elongated slot 25, but is prevented from moving in the vertical direction. The pinion 26 is kept in continuous meshing engagement with the teeth 4a of driving wheels 4.

FIG. 9 shows the toy 1 running in a leftward direction as viewed in the drawing, with teeth 4a rotatively driving pinion 26. As a result, the driving wheels 4 are rotated in the direction of arrow E, while pinion 26 is rotated in the direction of arrow F. As a result, the shaft 27 is pressed toward the left-hand side end of slot 25, and pinion 26 comes out of one end of rack 23 and into recess 24. With pinion 26 thus received by recess 24, an idling state is defined.

If the direction of rotation of the driving wheel 4 has been changed, i.e., from rotation in the normal direction to the reverse direction as described hereinabove, the driving wheel 4 is rotated in the direction of arrow G, and accordingly pinion 26 rotates in the direction of arrow H. As a result, pinion 26 moves along slot 25 from the left-hand end thereof and meshes with one end 23a of rack 23. As a result of engagement of pinion 26 with rack 23, head 3 is rotated until pinion 26 reaches the other end 23b of rack 23. Then, the pinion 26 comes into recess 24 adjacent to end 23b, so as to idle. The head 3 is directed in the running direction. The same operation is made to turn the head 3 in the opposite direction, when the direction of rotation of driving wheels 4 is switched from the direction G to the direction E. Thus, the head 3 is always directed in the running direction, regardless of the change in running direction of toy 1.

As shown in FIG. 9, the beak 22 of toy 1 is defined by an upper jaw 22b and a lower jaw 22a. The lower jaw 22a has a rear extension 22c extending rearwardly therefrom into head 3. Extension 22c is pivoted to the head 3 by means of a pin 29. The lower jaw 22a has protrusions 22d protruding upwardly from the portions of its side walls proximal to the extension 22c. The lower jaw 22a is pivoted at protrusions 22d to the upper jaw 22b, by means of a shaft 30. The front end of head 3 is opened, and a stepped retaining portion 32 is formed in the upper edge of such opening. A projection 31 extending rearwardly from the portion of upper jaw 22b through which the shaft 30 passes abuts retaining portion 32 from the lower side of the latter. The body 2 is provided with a recess 28 for receiving the enlarged diameter portion 22e of lower jaw 22a.

As the head 3 is turned in the manner described hereinabove, the lower and upper jaws 22a, 22b forming beak 22 are rotated in unison, so that the lower jaw 22a comes out of recess 28. As a result, lower jaw 22a makes sliding contact with the outer surface of body 2, so that the lower jaw 22a is rotated upwardly around pin 29 in accordance with the change in the level of the outer surface of body 2. Consequently, the shaft 30 by which upper jaw 22b is pivoted is also raised, The projection 31 of upper jaw 22b is constantly restrained and retained by the retaining portion 32, so that the upward movement of shaft 30 causes upward rotation of upper jaw 22b around a pivot defined by projection 31. The stroke of this rotation of upper jaw 22b is larger than that of lower jaw 22b, so that upper jaw 22b is moved away from lower jaw 22a to open the beak 22 as illustrated in FIG. 10.

Then, as driving wheels 4 are reversed again, pinion 26 again comes into meshing engagement with rack 23, so that head 3 makes a half-turn to the starting position, with lower jaw 22b again being received by recess 28 (FIG. 9) to close beak 22.

Figure 11:
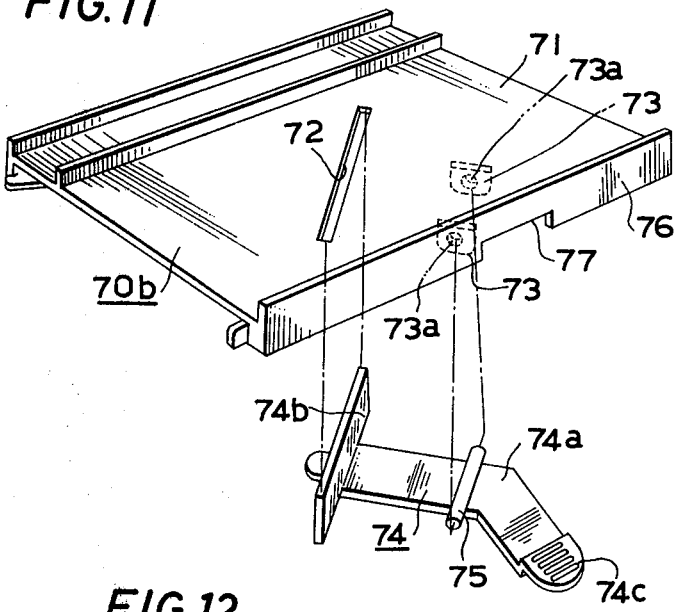
FIG. 11 is an exploded perspective view of a manually operable lever mounted on the track for causing a change in the running direction.
Figure 12:
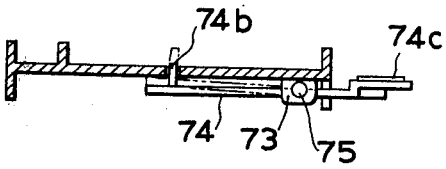
FIG. 12 is a longitudinal sectional view of the lever shown in FIG. 11.

FIG. 11 shows a track piece 70b forming a part of track 70. Track piece 70b has a flattened track surface 71 in which an elongated slit 72 is formed to extend through track surface 71 from one side to the other thereof. Elongated slit 72 is formed at an inclination to the longitudinal direction of track piece 70b. A bracket 73 having bearing holes 73a is integrally suspended from the back side of track surface 71. A manual operation lever 74 has a curved lever body 74a provided at one end thereof with a projecting tab 74b extending upwardly therefrom. The length and thickness of projecting tab 74b is selected to correspond to the length and thickness of elongated slit 72, so that the projecting tab 74 may freely enter into and exit from slit 72. A depressing portion 74c is provided at the rear end of lever body 74a. A shaft 75 is formed integrally with lever body 74a, and extends laterally from the central portion of lever body 74a. The shaft 75 is received at both ends thereof by bearing holes 73a of bracket 73, while lever body 74a is loosely received by a recess 77 formed in the side wall 76 of track piece 70b. In this manner, manual operation lever 74 is attached to the back side of track piece 70b for vertical swinging movement relative thereto.

Figure 13:
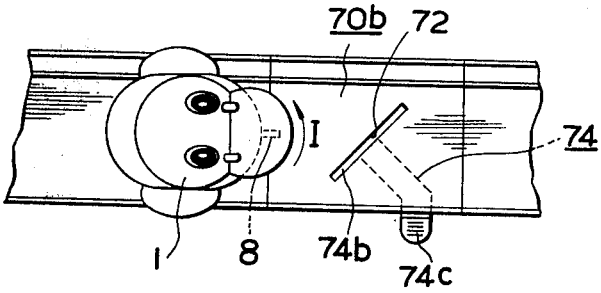
FIG. 13 is an illustration of a change in the running direction of the running toy member by means of a manually operable lever.

When running toy member 1 approaches track piece 70b incorporating manual operation lever 74 as shown in FIG. 13, switching lever 8 comes into contact with projecting tab 74b, if the latter has been projected upwardly through elongated slit 72 by depressing depressing portion 74c with a finger. Because projecting tab 74b is inclined relative to the longitudinal direction of track 70, the switching lever 8 is guided and swung by projecting tab 74b in the direction I, to thereby trigger the abovedescribed operation for changing the running direction. As a result, the driving wheels 4 are reversed and the running toy member 1 makes a turn at this position. Changing of the running direction of toy 1 can thus be achieved not only at the starting and terminal ends of track 70, but also at any desired portion of the track, by placing track piece 70b having manual operation lever 74 at the desired portion of track 70.

Although there have been described what are at present considered to be the preferred embodiments of the invention, it will be understood that the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A toy comprising:

a track;

a running toy member having rotatable driving wheels, said running toy member being adapted to run along said track by rotation of said driving wheels;

said running toy member including a body, and a switching arm attached to the lower surface of said body;

a lever operatively connected to said switching arm and disposed in said body of said running toy member;

a first shaft having a first worm gear disposed thereon, said first shaft being mounted proximal to said lever;

a driving gear connected to a driving power source;

a gear attached to said first shaft and directly meshing with said driving gear;

a driven gear connected to said driving wheels; and an intermediate gear by which said gear attached to said first shaft meshes with said driven gear, wherein:

said lever and said gear attached to said first shaft are brought into relative meshing engagement by swinging movement of said switching arm to move said first shaft in the axial direction, whereby said gear attached to said first shaft is brought into direct meshing engagement with said driven gear connected to said driving wheels to reverse the rotational direction of said driving wheels.

2. A toy according to claim 1, further comprising:

a spring attached to said first shaft, said spring being adapted to bias said first shaft in one direction and to be compressed as said first shaft is moved in the other direction; and said spring being further adapted to re-set said first shaft to the starting position when said lever is disengaged from said first worm gear to bring said gear attached to said first shaft into indirect meshing engagement with said driven gear via said intermediate gear.

3. A toy according to claim 1, further comprising:

teeth formed on the peripheral surfaces of said driving wheels;

gears disposed on a second shaft disposed on at least one end of said track and adapted to mesh with said teeth of said driving wheels;

a second worm gear disposed on said second shaft and adapted to be engaged by said switching arm; and said switching arm being swung by rotation of said second worm gear.

4. A toy according to claim 1, wherein:

said track includes a plurality of track pieces connected in series, one of said track pieces comprising an inclined track piece having a slope;

said inclined track piece being provided with racks for meshing engagement with said teeth formed on said driving wheels; and said toy further comprises engaging tabs projecting from said running toy member in the running direction thereof, and notches formed at the lower portion of said inclined track piece and cooperating with said engaging tabs such that said engaging tabs enter the back side of said inclined track piece, whereby said toy ascends said inclined track piece due to the support of the weight by said engaging tabs and the meshing of said teeth of said driving wheels with said rack.

5. A toy according to claim 1, wherein:

said running toy member further comprises a head rotatable with respect to said body;

said head being formed with a rack on the lower edge of said head; and a pinion provided on one side of said body and driven by constant meshing with said teeth formed on said driving wheel, said pinion being adapted to alternatively mesh with said rack of said head, whereby said head is turned by rotation of said driving wheels when said pinion meshes with said rack of said head.

6. A toy according to claim 5, wherein:

said rack is formed substantially over the semi-circular lower edge of said head, said lower edge being recessed upwardly at both sides of said rack to form recesses which do not engage said pinion, to allow idling of said pinion;

said pinion has a shaft loosely received by an elongated slot provided in said body, such that said pinion is movable along the length of said elongated slot; and wherein:

as said driving wheels are reversed said pinion is moved along the length of said elongated slot into meshing engagement with said rack, whereby said head is turned in accordance with reversal of said driving wheels.

7. A toy according to claim 1, wherein:

said running toy member has upper and lower jaws;

said lower jaw is rotatably pivoted at its rear end to said running toy member;

said upper jaw is pivoted to said lower jaw at a portion of said lower jaw spaced forwardly from the pivoted rear end thereof; and said upper jaw is retained at its rear end by said running toy member, whereby said upper jaw is swung with respect to said lower jaw as said lower jaw is swung in a vertical plane.

8. A toy according to claim 7, wherein:

said jaws are attached to a head which is rotatable with respect to said body of said running toy member, said body being provided with a recess for receiving said lower jaw; and said lower jaw is adapted to slide out of said recess to swing upwardly around said rear end pivot as said head is rotated with respect to said body, to swing said upper jaw upwardly away from said lower jaw.

9. A toy according to claim 1, wherein said track comprises a plurality of track pieces connected in series, said track pieces including:

a manual operation lever attached to at least one of said track pieces;

an elongated slit formed in said at least one track piece at an inclination to the longitudinal direction of said at least one track piece, and extending through said track piece; and a projecting tab formed on said manual operation lever and adapted to be projected through said elongated slit from the lower side to the upper side of said track piece, said projecting tab being engageable with said switching arm of said running toy member to cause swinging of said switching arm upon engagement with said switching arm.

* * * * *